US005917531A

United States Patent [19]

Nagahata et al.

[11] Patent Number: 5,917,531

[45] Date of Patent: Jun. 29, 1999

[54] THERMAL HEAD AND METHOD OF MANUFACTURING THE SAME

[75] Inventors: Takaya Nagahata; Shinobu Obata, both of Kyoto; Hiroshi Hashimoto, Amagi; Takuma Honda, Amagi; Tetsuya Yamamura, Amagi; Masanobu Kuboyama, Amagi, all of Japan

[73] Assignee: Rohm Co., Ltd., Kyoto, Japan

[21] Appl. No.: 08/930,291

[22] PCT Filed: Feb. 13, 1997

[86] PCT No.: PCT/JP97/00392

§ 371 Date: Oct. 1, 1997

§ 102(e) Date: Oct. 1, 1997

[87] PCT Pub. No.: WO97/29915

PCT Pub. Date: Aug. 21, 1997

[30] Foreign Application Priority Data

Feb. 13, 1996 [JP] Japan ..... 8-25270
Feb. 21, 1996 [JP] Japan ..... 8-33425

[51] Int. Cl.[6] ..... B41J 2/335

[52] U.S. Cl. ..... 347/202

[58] Field of Search ..... 347/200, 202

[56] References Cited

U.S. PATENT DOCUMENTS 4,973,986 11/1990 Narita ..... 347/202

FOREIGN PATENT DOCUMENTS 62-105644 5/1987 Japan .
2-130155 5/1990 Japan ..... 347/202
5-38834 2/1993 Japan .
7-23265 5/1995 Japan .
7-195720 8/1995 Japan .

*Primary Examiner*—Huan Tran
*Attorney, Agent, or Firm*—Merchant, Gould, Smith, Edell, Welter & Schmidt

[57] ABSTRACT

A thermal head of the present invention includes an insulating substrate (1), a bulging glaze layer (2) of amorphous glass formed on a surface of the insulating substrate (1), a heating resistor layer (5) formed on the bulging glaze layer (2), an electrode-carrying glaze layer (3) formed on the surface of the insulating substrate (1) to partially overlap the bulging glaze layer (2), and an electrode layer (4) formed on the electrode-carrying glaze layer (3) to partially overlap the heating resistor layer (5). Each of the bulging glaze layer (2) and the electrode-carrying glaze layer (3) is made of amorphous glass. The electrode-carrying glaze layer (3) has a smaller thickness than the bulging glaze layer (2). Thus, it is possible to bake the electrode-carrying glaze layer (3) at a lower temperature than the baking temperature for the bulging glaze layer (2).

19 Claims, 7 Drawing Sheets

THERMAL HEAD AND METHOD OF MANUFACTURING THE SAME

TECHNICAL FIELD

The present invention relates to a thermal head used for a thermal printer or a facsimile machine. In particular, the present invention relates to a thermal head including a bulging glaze layer, and to a method of making such a thermal head.

BACKGROUND ART

A thermal head is well known that includes a bulging glaze layer formed on an insulating substrate in an upheaved manner like a convex lens, and a heating resistor layer formed on the bulging glaze layer. The bulging glaze layer serves to facilitate the contact of transfer ribbon or thermosensitive recording paper with the heating resistor layer, while also serving to improve the heat-reserving performance at heating portions. A thermal head having such an arrangement is disclosed in Japanese Utility Model Publication No. 7-23265 for example.

For convenience of explanation, the specific arrangement of the thermal head disclosed in the above publication will be described with reference to FIG. 8 of the accompanying drawings of the application. As shown in the figure, in the well-known thermal head, a bulging glaze layer 22 made of amorphous glass is formed on a ceramic insulating substrate 21, and an electrode-carrying glaze layer 23 made of crystallized glass is formed to partially overlap an edge portion 22*a* of the bulging glaze layer 22. Further, a heating resistor layer 25 and an electrode layer 24 are formed on the electrode-carrying glaze layer 23.

With such an arrangement, the electrode-carrying glaze layer 23 is present at the border between the edge portion 22*a* of the bulging glaze layer 22 and the insulating substrate 21. Thus, the height difference at the border is reduced. Therefore, it is possible to prevent the heating resistor layer 25 and the electrode layer 24, each of which is formed with a small thickness on the electrode-carrying glaze layer, from being cut off or having improper resistance due to the large height difference.

In the above conventional thermal head, the bulging glaze layer 22 is made of amorphous glass, whereas the electrode-carrying glaze layer 23 is made of crystallized glass for the following reason. In forming the electrode-carrying glaze layer 23, a glass paste material for the electrode-carrying glaze layer 23 is printed on the bulging glaze layer 22, and then the printed glass paste is baked. Thus, if the baking temperature for the glass paste is equal to or higher than the baking temperature for the bulging glaze layer 22, the bulging glaze layer 22, which is formed earlier, is unduly softened to undergo deformation, thereby giving rise to inconveniences. For instance, the upheaved portion of the bulging glaze layer 22 may be unduly reduced in height. For purposes of preventing such an inconvenience, conventionally, the electrode-carrying glaze layer 23 is made of a crystallized glass which can be baked at a lower temperature compared to the amorphous glass used for forming the bulging glaze layer 22.

However, with the conventional arrangement, the electrode-carrying glaze layer 23 and the bulging glaze layer 22 are respectively made of a different material. Thus, in forming these two glaze layers 22, 23, it is necessary to prepare two kinds of material and selectively use either material depending on the kind of the glaze layers. Such a procedure is troublesome, and production efficiency remains yet to be improved.

Further, in such a thermal head in general, the surfaces of the heating resistor layer 25 and the electrode layer 24 are covered by an insulating protection layer (not shown) made of a glass material. It is preferable to form the insulating protection layer from an amorphous glass capable of providing a smoother surface than a crystallized glass, since the insulating protection layer is brought into direct contact with a transfer ink ribbon or thermosensitive recording paper. When the insulating protection layer is made of amorphous glass, the materials of the electrode-carrying glaze layer 23 and the insulating protection layer differ in kind. Thus, when the electrode-carrying glaze layer 23 is made of crystallized glass, the number of material replacement becomes still larger, thereby decreasing the production efficiency.

Further, in the conventional thermal head, the electrode-carrying glaze layer 23 is made of crystallized glass, which provides a coarser surface than an amorphous glass. Thus, cutoffs are likely to occur in the heating resistor layer 25 and the electrode layer 24 formed on the surface of the electrode-carrying glaze layer. Thus, the conventional arrangement remains yet to be improved also in view of the prevention of the cutoff in the heating resistor layer 25 and the electrode layer 24 formed on the surface of the electrode-carrying glaze layer 23.

DISCLOSURE OF THE INVENTION

Therefore, it is an object of the present invention to provide a thermal head which can be properly produced without giving rise to inconveniences such as reduction in height of the upheaved portion of the bulging glaze layer, and occurrence of cutoffs in the electrode layer or the heating resistor layer.

Another object of the present invention is to provide a method of making such a thermal head.

According to a first aspect of the present invention, there is provided a thermal head comprising: an insulating substrate; a bulging glaze layer of amorphous glass formed on a surface of the insulating substrate; a heating resistor layer formed along the bulging glaze layer; an electrode-carrying glaze layer formed on said surface of the insulating substrate to partially overlap the bulging glaze layer; and an electrode layer formed on the electrode-carrying glaze layer to partially overlap the heating resistor layer. Each of the bulging glaze layer and the electrode-carrying glaze layer is made of amorphous glass. The electrode-carrying glaze layer has a smaller thickness than the bulging glaze layer.

The advantages of the above arrangement will be described in relation to the embodiments described hereinafter.

The electrode-carrying glaze layer and the bulging glaze layer may be made of a same amorphous glass material. In this case, the same amorphous glass material may be alumina glass for example.

Alternatively, the electrode-carrying glaze layer and the bulging glaze layer may be respectively made of a different amorphous glass material. In this case, the bulging glaze layer may be made of amorphous alumina glass for example, and the electrode-carrying glaze layer may be made of amorphous lead glass for example.

Further, the electrode layer and the heating resistor layer may be covered by an insulating protection layer made of an amorphous glass. In this case, the insulating protection layer and the electrode-carrying glaze layer may be made of the same amorphous glass (alumina glass or lead glass for example).

According to an embodiment of the present invention, the surface of the insulating substrate is entirely covered by the electrode-carrying glaze layer except for a region provided with the bulging glaze layer, and at least one drive IC is directly mounted on the electrode-carrying glaze layer for selective heating of the heating resistor layer.

According to another embodiment, a driver-carrying glaze layer is formed on the surface of the insulating substrate at a position spaced from the bulging glaze layer for carrying at least one drive IC. The electrode-carrying glaze layer bridges between the bulging glaze layer and the driver-carrying glaze layer.

In each of the above embodiments, the electrode-carrying glaze layer is made of an amorphous glass material (e.g. lead glass) having a lower softening point than the bulging glaze layer. In the latter embodiment, the driver-carrying glaze layer and the bulging glaze layer are made of a same amorphous glass material (e.g. alumina glass).

According to a second aspect of the present invention, there is provided a method of making a thermal head comprising the steps of: forming a bulging glaze layer of an amorphous glass on a surface of an insulating material; forming an electrode-carrying glaze layer on said surface of the insulating substrate so that the electrode-carrying glaze layer partially overlaps the bulging glaze layer; and forming a heating resistor layer and an electrode layer in an overlapping manner on the bulging glaze layer. The forming step of the electrode-carrying glaze layer includes a first procedure of printing an amorphous glass paste in a manner causing the amorphous glass paste to partially overlap the bulging glaze layer and have a thickness smaller than a height of the bulging glass layer, and a second procedure of baking the printed amorphous glass paste at a temperature lower than a temperature for baking the bulging glaze layer.

The above method may further include the step of mounting at least one drive IC on the electrode-carrying glaze layer. The drive IC is electrically connected to the electrode layer. Further, a driver-carrying glaze layer may be formed together with but spaced from the bulging glaze layer. The driver-carrying glaze layer may support at least one drive IC electrically connected to the electrode layer.

Other objects, features and advantages of the present invention will become clearer from preferred embodiments described below with reference to the accompanying drawings.

BEST MODE FOR CARRYING OUT THE INVENTION

Preferred embodiments of the present invention will be specifically described below with reference to the drawings.

Figure 1:
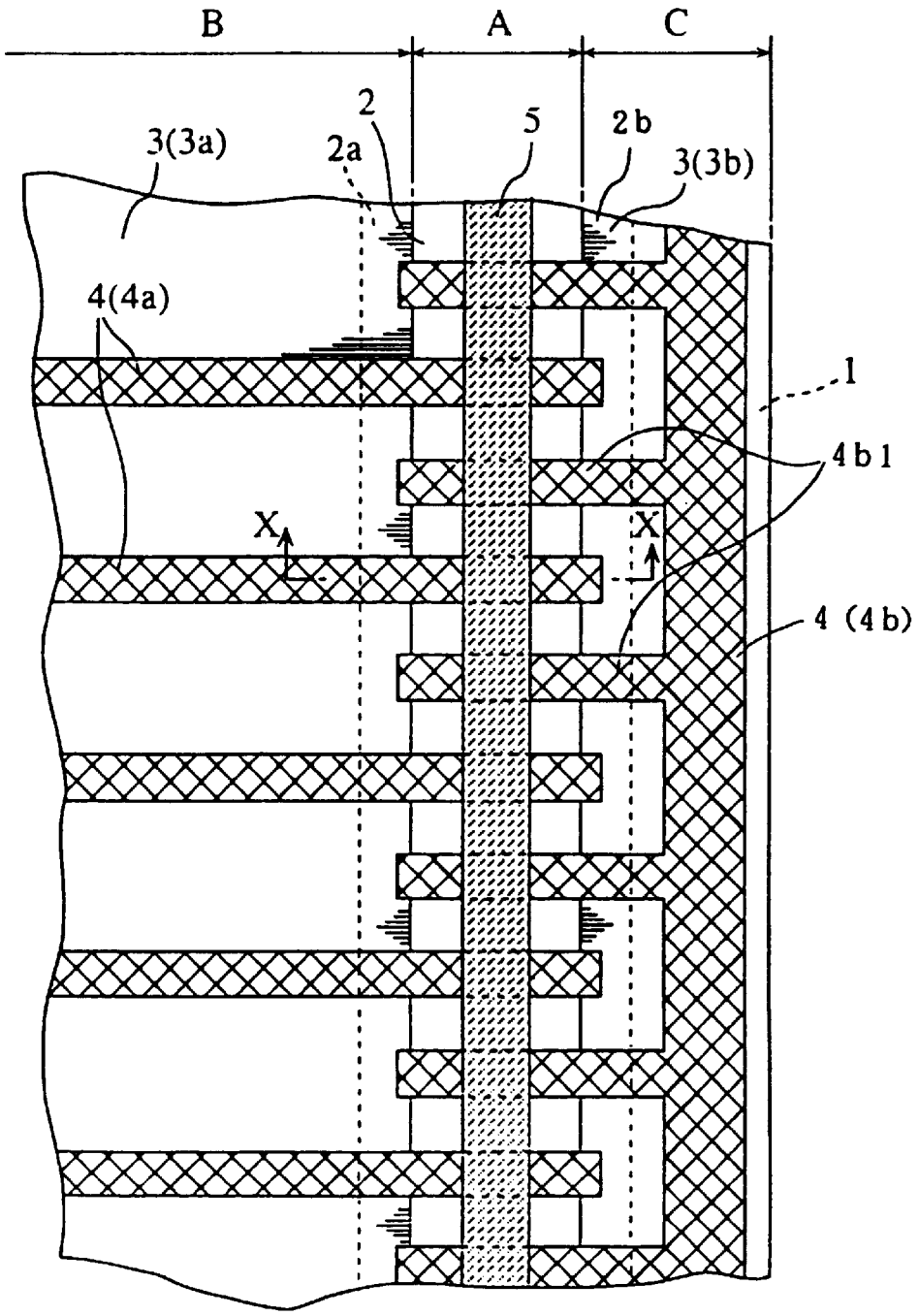
FIG. 1 is a plan view showing principal portions of a thermal head according to a first embodiment of the present invention.
Figure 1A:
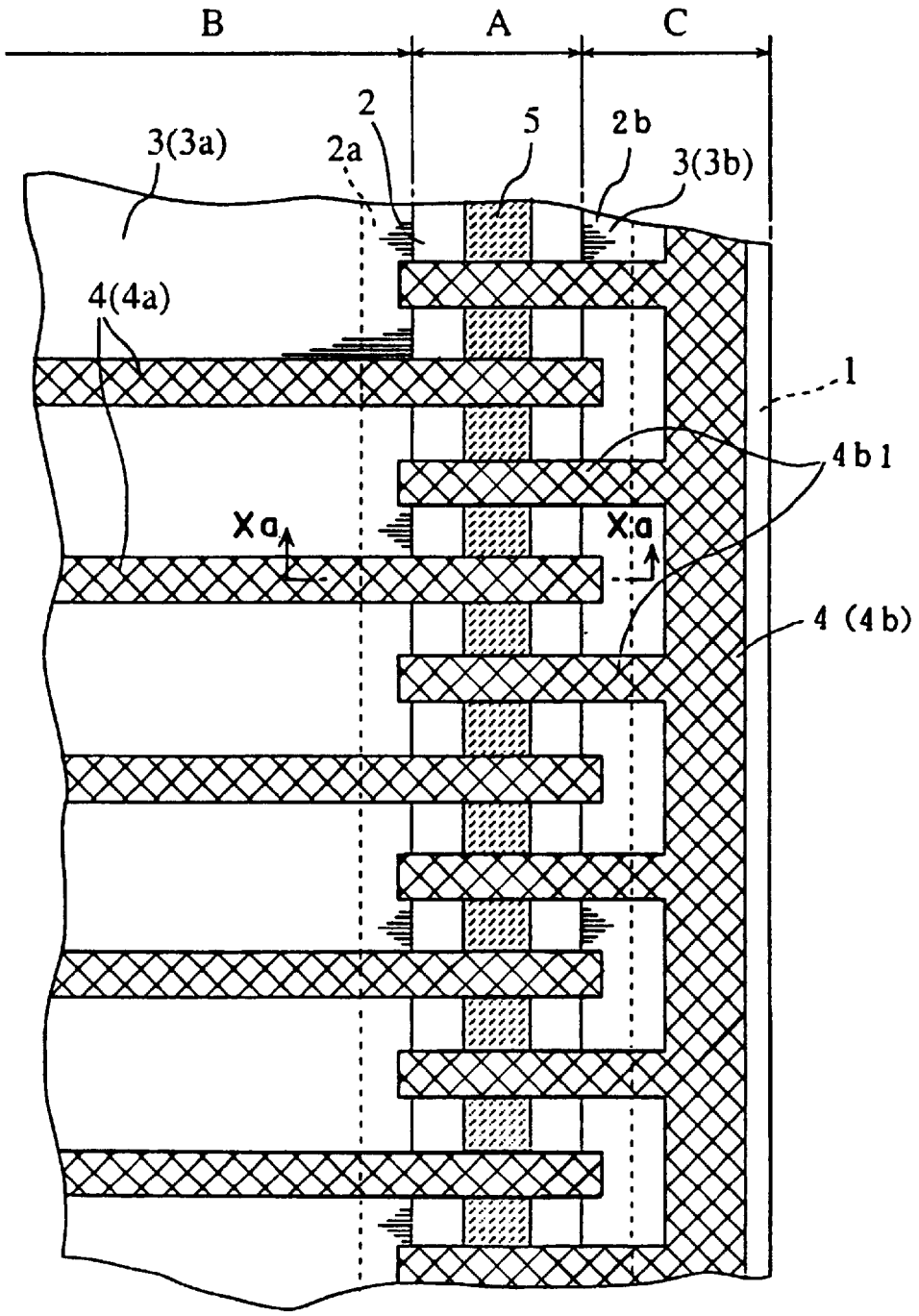
FIG. 1*a* is a plan view showing principal portions of a thermal head according to another embodiment of the present invention.
Figure 2:
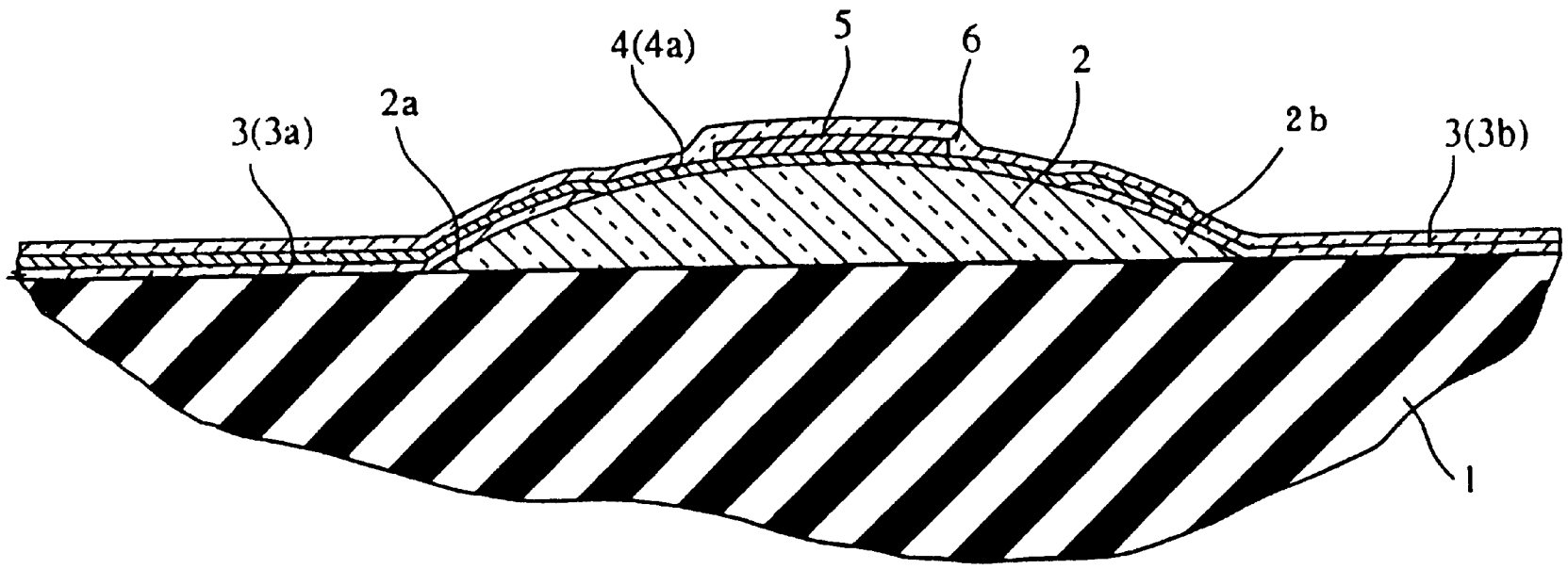
FIG. 2 is an enlarged sectional view taken along lines X—X of FIG. 1.
Figure 2A:
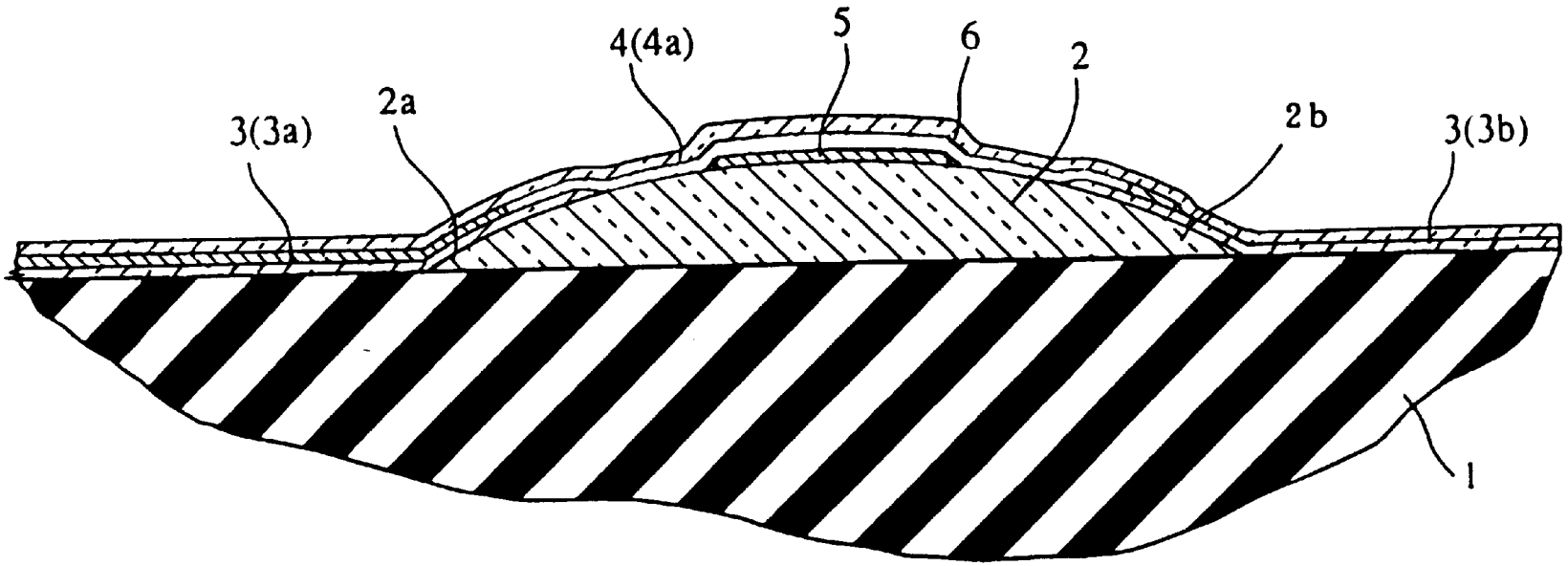
FIG. 2*a* is an enlarged sectional view taken along lines X*a*—X*a* of FIG. 1*a,*
Figure 3:
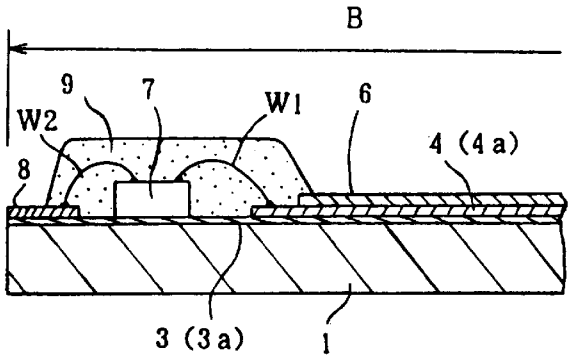
FIG. 3 is a sectional view showing a drive IC and its relevant portions mounted on the thermal head.
Figure 4:
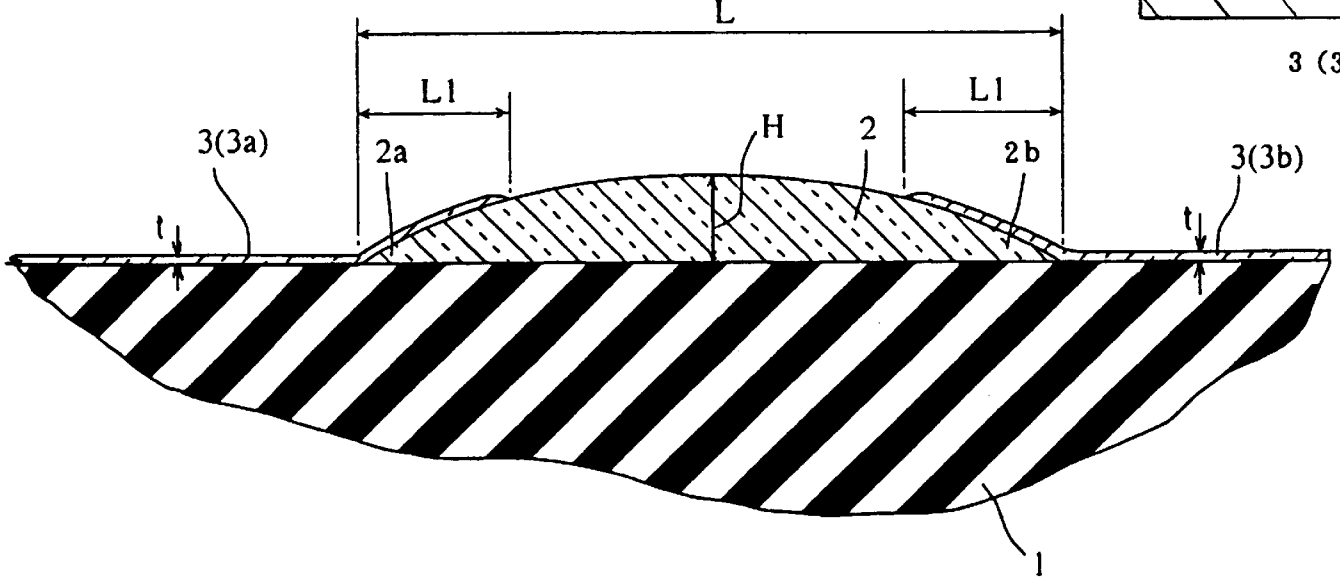
FIG. 4 is an enlarged principal sectional view showing the thermal head of FIG. 1 in the making.

FIGS. 1–3 show a thermal head according to a first embodiment of the present invention. FIG. 1 is a plan view showing principal parts of the thermal head, and FIG. 2 is an enlarged sectional view showing principal parts taken along lines X—X in FIG. 1. FIG. 3 is an enlarged sectional view showing principal parts of the thermal head of FIG. 1 in the making.

The thermal head shown in FIGS. 1–3 is the so-called thick film type. Referring to FIG. 2, the thermal head includes a ceramic insulating substrate 1. The insulating substrate 1 has a surface formed with a bulging glaze layer 2, an electrode-carrying glaze layer 3, an electrode layer 4, a heating resistor layer 5 and an insulating protection layer 6 which are successively stacked.

The bulging glaze layer 2 is formed into a strip having a predetermined width and located in a region adjacent to one of the edges of the surface of the insulating substrate 1. The bulging glaze layer is made of an amorphous glass such as alumina glass ($SiO_2$—$Al_2O_3$) for example. The bulging glaze layer 2 is obtained by printing a predetermined thickness of an amorphous glass paste on the surface of the insulating substrate 1 and baking the paste at about 1200° C. Specific sizes of the bulging glaze layer 2 may be about 1200 $\mu$m for its width L and about 50 $\mu$m for its bulging height (the maximum thickness) H for example.

The electrode-carrying glaze layer 3 includes a first portion 3*a* covering a region B located on a side of the bulging glaze layer 2, and a second portion 3*b* covering a region C located on the opposite side of the bulging glaze layer 2. The first portion 3*a* overlaps a longitudinal edge 2*a* of the bulging glaze layer 2, whereas the second portion 3*b* overlaps the other longitudinal edge 2*b* of the bulging glaze layer 2.

The electrode-carrying glaze layer 3 is made of the same amorphous glass material as used for the bulging glaze layer 2. However, the thickness of the electrode-carrying glaze layer is rendered far smaller than that of the bulging glaze layer 2. For instance, the electrode-carrying glaze layer 3 has a thickness t of about 6 $\mu$m, while the overlapping thickness of the bulging glaze layer 2 and the respective longitudinal edges 2*a*, 2*b* is about 300 $\mu$m.

The electrode-carrying glaze layer 3 is prepared by printing a predetermined thickness of the amorphous glass paste to overlap the respective longitudinal edges 2*a*, 2*b* of the bulging glaze layer 2 after the bulging glaze layer 2 is formed, and baking the above glass paste. However, the baking temperature at the latter procedure should be lower than a baking temperature for forming the bulging glaze layer 2. The electrode-carrying glaze layer 3 and the bulging glaze layer 2 are similar in that they both are made of amorphous glass. However, the electrode-carrying glaze layer 3 is smaller in thickness, and therefore liable to be heated up. Thus, it is possible to properly bake the electrode-carrying glaze layer 3 even at a lower temperature than the baking temperature for forming the bulging glaze layer 2.

As shown in FIG. 1, the electrode layer 4 includes a plurality of individual electrodes 4*a* and a common electrode 4*b* having a plurality of comb-like teeth 4*b*1. The comb-like teeth 4*b*1 of the common electrode 4*b* and the individual electrodes 4*a* are alternately arranged. The electrode layer 4 may be formed by printing a predetermined pattern of a conductive paste containing e.g. gold as the main component by a thick film printing method. The thickness of the electrode layer 4 may be about 0.6 μm for example.

The heating resistor layer 5 is formed on the electrode layer 4 at a position corresponding to the widthwise central portion (the apex) of the bulging glaze layer 2. More specifically, the heating resistor layer 5 is formed in a strip which is alternately engaged by the individual electrodes 4*a* and the comb-like teeth 4*b*1 of the common electrode 4*b*. The heating resistor layer 5 has regions or dots defined between adjacent common electrode teeth 4*b*. When a voltage is impressed on a selected individual electrode 4*a*, a corresponding region of the heating resistor layer 5 between adjacent common electrode teeth 4*b* is heated. In such an arrangement, a transfer ink ribbon or thermosensitive recording paper is heated by the dot. The heating resistor layer 5 is also formed by a thick film printing method to have a thickness of about 3.5 μm for example.

As shown in FIG. 3, the controlling of voltage to be impressed on the heating resistor layer 5 is performed by a plurality of drive ICs 7 (only one drive IC is shown in FIG. 3) mounted on the second portion 3*b* of the electrode-carrying glaze layer 3. The output pads of the drive IC 7 are connected via gold wires W1 to individual electrodes 4*a*, while the input pads of the drive IC are connected via gold wires W2 to a conductive wiring pattern 8 formed on the first portion 3*a* of the electrode-carrying glaze layer 3. The conductive wiring pattern 8 is arranged to be electrically connected to proper terminals (not shown), so that necessary drive voltages and various controlling signals are input to the drive ICs 7. The conductive wiring pattern 8 may be formed simultaneously with the electrode layer 4 (that is, the individual electrodes 4*a* and the common electrode 4*b*). The drive ICs 7 and the bonding portions of the gold wires W1, W2 are coated by a hard resin member 9 for protection.

The insulating protection layer 6 covers the heating resistor layer 5 and the electrode layer 4 for protection. The insulating protection layer 6 may be made of an amorphous glass similar to the amorphous glass used for making the bulging glaze layer 2 or the electrode-carrying glaze layer 3. In the present embodiment, the insulating protection layer 6 is made of the same material as used for the bulging glaze layer 2 and the electrode-carrying glaze layer 3. The insulating protection layer 6 is made considerably thinner than the bulging glaze layer 2, and may have a thickness of 6 μm for example. Thus, in baking a printed amorphous glass to make the insulating protection layer 6, it is possible to perform the baking at a lower temperature, like in baking the electrode-carrying glaze layer 3, than the baking temperature for the bulging glaze layer 2.

In the thermal head having the above arrangement, the electrode-carrying glaze layer 3 is formed to overlap the respective longitudinal edges 2*a*, 2*b* of the bulging glaze layer 2. Thus, the change in height between the bulging glaze layer 2 and the insulating substrate 1 is absorbed by the electrode-carrying glaze layer 3 to some extent. Further, the electrode-carrying glaze layer 3, which is made of amorphous glass, can inherently have a surface which is smoother than the surface of a crystallized glass. Further, the electrode-carrying glaze layer 3 is formed over the entire surface of the insulating substrate 1 except for a region provided with the bulging glaze layer 2. Thus, the entirety of the electrode layer 4 (4*a*, 4*b*) may be formed on the surface of the electrode-carrying glaze layer 3. As a result, even though the electrode layer 4 is formed to have a remarkably small thickness of about 0.6 μm, it is possible to prevent the individual electrodes 4*a* or the common electrode 4*b* from being electrically cut off. Further, the prevention of the cutoff of the individual electrodes 4*a* or the common electrode 4*b* makes it possible to prevent the heating resistor layer 5 on the electrode layer 4 from being cut off.

Further, in the above thermal head, the bulging glaze layer 2, the electrode-carrying glaze layer 3 and the insulating protection layer 6 are all made of the same amorphous glass. Therefore, in producing the thermal head, there is no need to prepare a separate paste material of crystallized glass in addition to the amorphous glass. Thus, since the above three layers are made from a single material, the material management may be facilitated.

As already described, the electrode-carrying glaze layer 3 and the insulating protection layer 6 have a thickness smaller than the height H of the bulging glaze layer 2, and therefore can be baked at a temperature lower than the baking temperature for the bulging glaze layer 2. Thus, in baking the electrode-carrying glaze layer 3 and the insulating protection layer 6, it is possible to prevent the upheaved height H of the bulging glaze layer 2 from reducing. As a result, the upheaved height H of the bulging glaze layer 2 is maintained at a predetermined value, so that the contacting behavior (and hence the printing quality) of the thermal head to a transfer ribbon or thermosensitive paper is improved.

Further, the heating resistor layer 5 is covered by the insulating protection layer 6 of amorphous glass having a smooth surface. Thus, smooth contact with the transfer ribbon or the thermosensitive paper is achieved. Still further, when the insulating protection layer 6 is formed by the same material used for the electrode-carrying glaze layer 3, the insulating protection layer 6 and the electrode-carrying glaze layer 3 are advantageously adhered to each other. Thus, it is possible to prevent the insulating protection layer 6 from being easily detached. In addition, the mechanical strength of the electrode carrying glaze layer 3 is improved.

Still further, the surface of the electrode-carrying glaze layer 3 is smooth. Therefore, it is possible to obtain an additional advantage in a sense that the drive IC 9 can be directly mounted on the surface with improved adherence.

In the above embodiment, the bulging glaze layer 2 is formed to have a width of about 12000 μm and a thickness of about 50 μm, whereas the electrode-carrying glaze layer 3 has a thickness of about 6 μm. However, specific dimensions of each element of the present invention may be varied in many ways. However, the electrode-carrying glaze layer 3 for example may preferably have a thickness of 5–20 μm when the bulging glaze layer 2 has the above-mentioned size. This is because that when the thickness of the electrode-carrying glaze layer 3 exceeds 20 μm, the baking temperature for this layer is increased so that it becomes difficult to distinguish the baking temperature for this layer and the baking temperature for the bulging glaze layer 2, and that when the thickness is no more than 5 μm, it is difficult to absorb the height difference at the border between the bulging glaze layer 2 and the insulating substrate 1. According to the present invention, with the above circumstances in mind, the thickness of the electrode-carrying glaze layer 3 may be suitably determined in correspondence with the size of the bulging glaze layer 2.

In the above embodiment, the so-called thick film type thermal head is taken as an example to be described. However, the present invention is not limited to this but also applicable to the so-called thin film type thermal head. For a thin film type thermal head, a step of forming a predetermined thin film by vapor deposition or sputtering and a step of etching the thin film may be repeated to successively form predetermined portions. Further, a thin film type thermal head includes the electrode layer and the heating resistor layer stacked in the reversed order compared with the thick film type. According to the present invention, however, the electrode layer and the heating resistor layer may be stacked in any order.

Further, in the above embodiment, the electrode-carrying glaze layer 3 is formed to overlap the respective longitudinal edges 2*a*, 2*b* of the bulging glaze layer 2. However, when the common electrode 4*b* is formed on the surface of the bulging glaze layer 2 alone for example, the common electrode 4*b* is not cut off due to the sudden change in height between the bulging glaze layer 2 and the insulating substrate 1. Therefore, in such an instance, the longitudinal edge 2*b* of the bulging glaze layer 2 is not necessarily overlapped by the electrode-carrying glaze layer 3, but only the other longitudinal edge 2*a* of the bulging glaze layer 2 may be overlapped by the electrode-carrying glaze layer 3.

Figure 5:
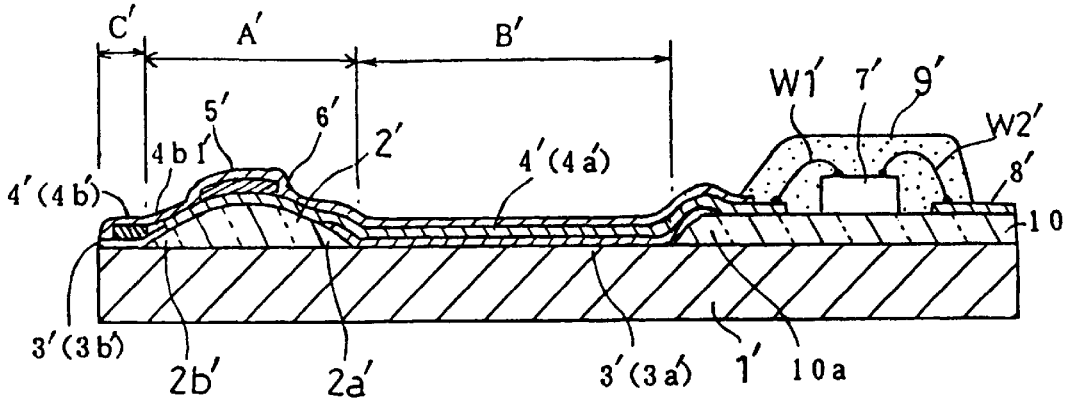
FIG. 5 is a sectional view showing a thermal head according to a second embodiment of the present invention.
Figure 6:
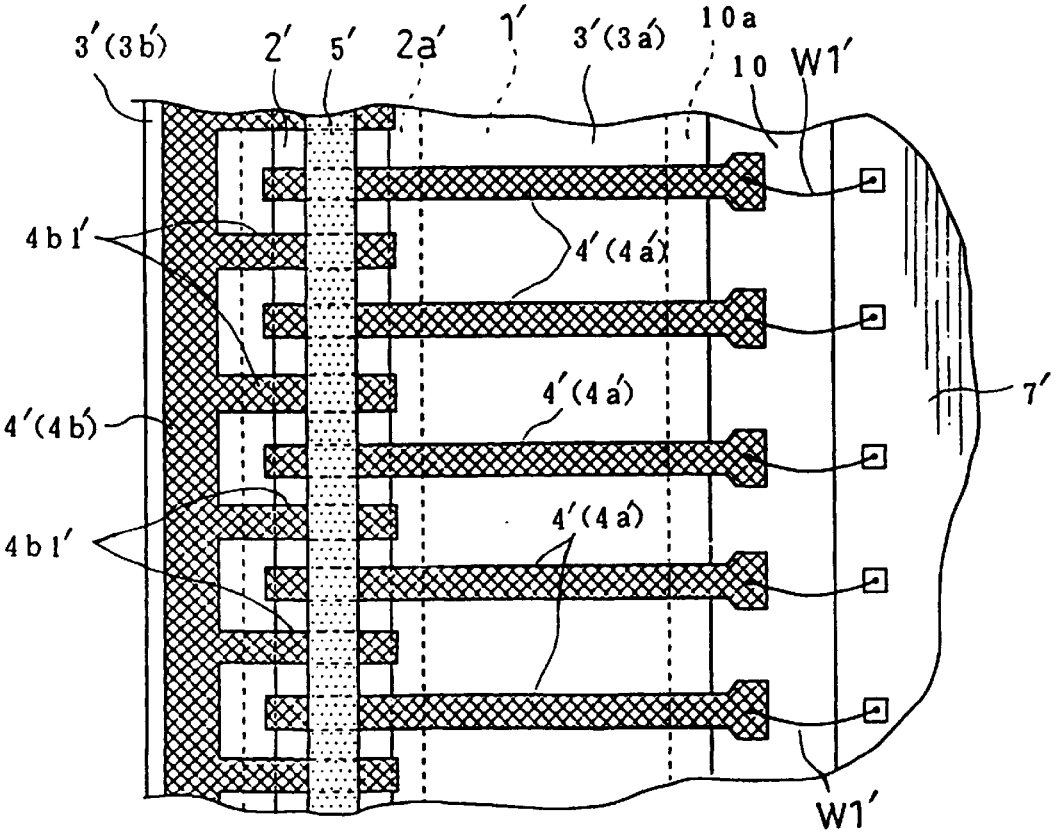
FIG. 6 is a plan view showing principal portions of the thermal head of FIG. 5.
Figure 7:
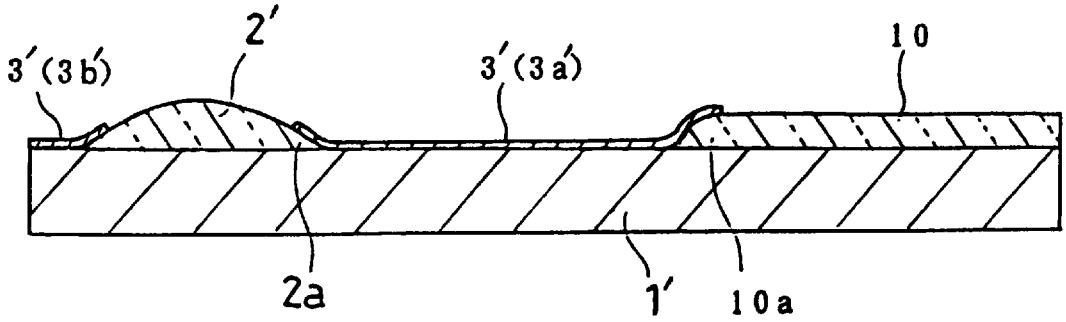
FIG. 7 is a sectional view showing the thermal head of FIG. 5 in the making.
Figure 8:
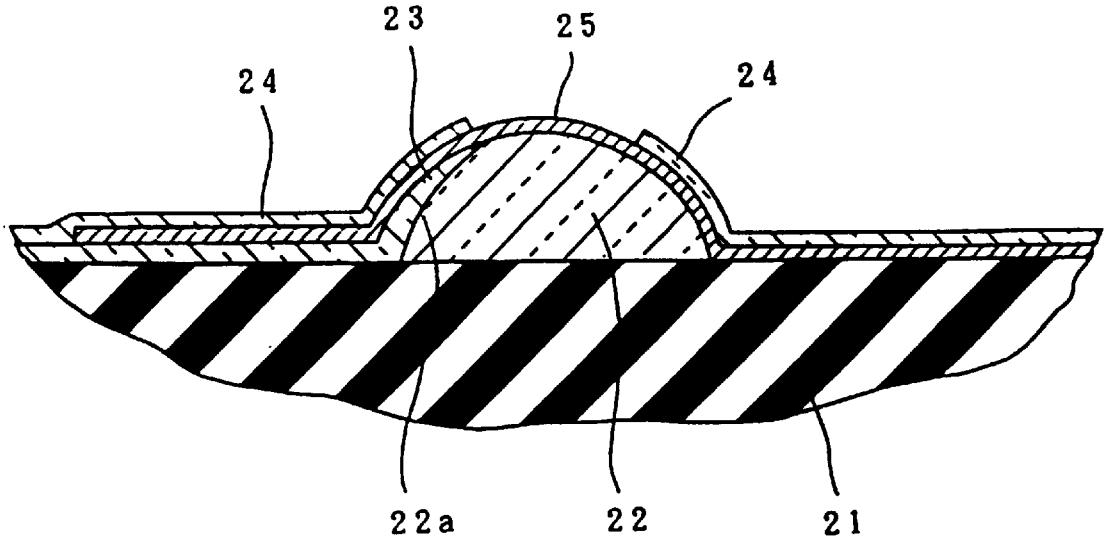
Fig. 8 Prior Art
FIG. 8 is an enlarged sectional view showing principal portions of a prior art thermal head.

FIGS. 5–7 show a thermal head according to a second embodiment of the present invention. The thermal head of the present embodiment includes a ceramic insulating substrate 1' with a surface provided with a stack of a bulging glaze layer 2', a driver-mounting glaze layer 10, an electrode-carrying glaze layer 3', an electrode layer 4', a heating resistor layer 5' and an insulating protection layer 6'. The driver-mounting glaze layer 10 carries drive ICs 7' mounted thereon.

Like the first embodiment, the bulging glaze layer 2' is formed into a strip. This strip has a predetermined width and a cross section upheaved from the surface of the insulating substrate 1. The bulging glaze layer 2' may be formed by an amorphous glass of alumina glass ($SiO_2$—$Al_2O_3$) having a softening point of 900–950° C. for example. The bulging glaze layer 2' is formed by printing an amorphous glass paste on the surface of the insulating substrate 1' a plurality of times so that the printed paste has a predetermined thickness, and baking the printed glass paste at a temperature of 1000–1300° C. for example, which is no less than the above-mentioned softening point. The bulging glaze layer 2' has a width of about 1200 μm for example and a upheaved height (the maximum thickness) of about 50 μm for example.

The driver-carrying glaze layer 10 is formed on the insulating substrate 1' and spaced from the bulging glaze layer 2' by a predetermined distance. The driver-carrying glaze layer 10 may be formed from the same material used for forming the bulging glaze layer 2'. Therefore, like in forming the bulging glaze layer 2', the driver-carrying glaze layer 10 is formed by printing the alumina glass paste up to a predetermined thickness, and baking the paste at a temperature of 1000–1300° C. for example. The baking operations for the driver-carrying glaze layer 10 and the bulging glaze layer 2' may be performed simultaneously in the same step. The thickness of the driver-carrying glaze layer 10 may be smaller than the upheaved height of the bulging glaze layer 2', or specifically be 30–40 μm for example.

The electrode-carrying glaze layer 3' is formed in regions B' and C' which correspond to the upper surface of the insulating substrate 1' except for a region A' provided with the bulging glaze layer 2' and a region provided with the driver-carrying glaze layer 10. Specifically, the electrode-carrying glaze layer 3' is divided into a first portion 3*a*' and a second portion 3*b*'. The first portion 3*a*' is formed in the region B' located between the bulging glaze layer 2' and the driver-carrying glaze layer 10 so that the first portion overlaps a longitudinal edge 2*a*' of the bulging glaze layer 2' and a longitudinal edge 10*a*' of the driver-carrying glaze layer 10. The second portion 3*b*' is formed in the region C' on the opposite side of the bulging glaze layer 2' to overlap the other longitudinal edge 2*b*'of the bulging glaze layer 2'.

In the present embodiment, unlike the bulging glaze layer 2' or the driver-carrying glaze layer 10, the electrode-carrying glaze layer 3' (3*a*', 3*b*') is made of amorphous glass such as a lead ($SiO_2$—PbO) glass having a softening point of about 730° C. Therefore, the present embodiment is different from the first embodiment in that the electrode-carrying glaze layer 3' is made of lead glass, but is the same as the second embodiment in that the glass is amorphous. The thickness of the electrode-carrying glaze layer 3' is remarkably smaller than that of the bulging glaze layer 2' or the driver-carrying glaze layer 10, and may be about 10 μm for example.

As shown in FIG. 7, the electrode-carrying glaze layer 3' is formed by printing a lead glass paste and baking the paste after the formation of the bulging glaze layer 2' and the driver-carrying glaze layer 10. The baking operation should be performed at a lower temperature than the softening point (900–950° C.) of the glass used for forming the bulging glaze layer 2' and the driver-carrying glaze 10. Specifically, after the printing operation of the glass paste used for forming the electrode-carrying glaze layer 4, the paste is desiccated at a temperature of about 150° C. and then baked at a temperature of about 850° C.

As shown in FIG. 6, the electrode layer 4' includes a plurality of individual electrodes 4*a*' and a common electrode 4*b*' with a plurality of comb-like teeth 4*b*1'. The comb-like teeth 4*b*1' of the common electrode 4*b*' are alternately arranged relative to the individual electrodes 4*a*'. The electrode layer 4' is formed by printing a conductive paste containing e.g. gold as the main component (resinated gold) into a predetermined pattern by a thick film printing method. The thickness of the electrode layer 4' may be about 0.6 μm for example. The electrode layer 4' is formed by screen-printing a conductive paste onto the bulging glaze layer 2', the electrode-carrying glaze layer 4' and the driver-carrying glaze layer 10, baking the conductive paste and patterning the same by photolithography.

The heating resistor layer 5' is formed on the electrode layer 4' at a position thereof corresponding in location to a widthwise central portion (the apex) of the bulging glaze layer 2'. More specifically, the heating resistor layer 5' is formed into a strip which is transversely crossed alternately by the individual electrodes 4*a*' and the comb-like teeth 4*b*1' of the common electrode 4*b*'. When voltage is impressed on a selected one of the individual electrodes 4*a*', a portion of the heating resistor layer 5' between the adjacent teeth of the common electrode 4*b*' is heated up as a unit dot to give heat to the transfer ribbon or the thermosensitive recording paper. The heating resistor layer 5' is also produced by a thick film printing method and has a thickness of about 3.5 μm for example.

The controlling of voltage impressed on the heating resistor layer 5' is performed by a plurality of drive ICs 7' (only one drive IC is shown in FIG. 5) mounted on the driver-carrying glaze layer 10. The output pads of the drive ICs 7' are connected via gold wires W1' to the respective individual electrodes 4*a*'. The input pads of the drive ICs are connected via gold wires W2' to a conductive wiring pattern 8' formed on the driver-carrying glaze layer 10. The conductive wiring pattern 8' serves to give necessary driving voltage and various control signals to the drive ICs 7' and is connected to suitable terminals (not shown). The conductive wiring pattern 8' may be formed simultaneously with the electrode layer 4' (i.e. the individual electrodes 4*a*' and the common electrode 4*b*'). The drive ICs 7' and each bonding portion of the gold wires W1', W2' are coated by a hard resin member 9' for protection.

The insulating protection layer 6' covers substantially the entirety of the heating resistor layer 5' and the electrode layer 4' for protection thereof. The insulating protection layer 6' is made of the same amorphous lead glass as used for the electrode-carrying glaze layer 3'. The insulating protection layer 6' may have a thickness of 6 μm for example and is remarkably thinner than the bulging glaze layer 2' and the driver-carrying glaze layer 10. Therefore, in printing amorphous glass and baking this to produce the insulating protection layer 6', this baking operation can be performed, like in the baking operation of the electrode-carrying glaze layer 3', at a lower temperature than the baking temperatures for the bulging glaze layer 2' and the driver-carrying glaze layer 10.

In the thermal head having the above arrangement, the individual electrodes 4*a*' are not directly formed on the surface of the insulating substrate 1' but on the surface of the electrode-carrying glaze layer 3' (3*a*'). In the experiments conducted by the inventors, while the average roughness (Ra) along the central line of the insulating substrate 1' was 0.3 μm, the average roughness along the central line of the electrode-carrying glaze layer 4 was advantageously rendered 0.04 ρm. When the individual electrodes 4*a*' are formed on the smooth surface of the electrode-carrying glaze layer 3', the cutoff of the individual electrodes 4*a*' due to the roughness of the surface underlying the same electrodes is effectively prevented. In the above-mentioned experiments, it has been found that the occurrence of cutoffs can be reduced to one twentieth when the individual electrodes 4*a*' are formed on the electrode-carrying glaze layer 3' compared to when the individual electrodes 4*a*' are directly formed on the surface of the insulating substrate 1'. This fact holds for the comb-like teeth 4*b*1' of the common electrode 4*b*' formed on the electrode-carrying glaze layer 3'.

It should be noted that the height difference between the bulging glaze layer 2' and the insulating substrate 1' is absorbed by the electrode-carrying glaze layer 3' to some extent since the electrode-carrying glaze layer 3' is formed to overlap the respective longitudinal edges 2*a*', 2*b*' of the bulging glaze layer 2'. Further, the electrode-carrying glaze layer 3'is made of amorphous glass, so that it will have a smoother surface than when made of crystallized glass. Further, the electrode-carrying glaze layer 3' is formed over the surface of the insulating substrate 1' except the regions provided with the bulging glaze layer 2' and the driver-carrying glaze layer 10. The entirety of the electrode layer 4' (4*a*', 4*b*') can be formed on the surface of the electrode-carrying glaze layer 3'. Thus, it is possible to prevent the cutoff of the individual electrodes 4*a*' or the common electrode 4*b*' even when the electrode layer 4' has a remarkably small thickness of about 0.6 μm. Further, owing to the prevention of the cutoff of the individual electrodes 4*a*' or the common electrode 4*b*', it is also possible to prevent the cutoff of the heating resistor layer 5' formed on the electrode layer 4'.

Further, the electrode-carrying glaze layer 3' and the insulating protection layer 6' of the thermal head are both made of the same amorphous lead glass. Therefore, in producing the thermal head for which the bulging glaze layer 2' and the driver-carrying glaze layer 10 are formed by an alumina glass paste, and then the alumina glass paste is replaced with a lead glass paste to form the electrode-carrying glaze layer 3', there is no need to replace the lead glass paste with the alumina glass paste to form the insulating protection layer 6'. Thus, the material handling is simplified.

As already described, the thickness of the electrode-carrying glaze layer 3' and the insulating protection layer 6' is remarkably smaller than the height of the bulging glaze layer 2' or the thickness of the driver-carrying glaze layer 10, and the lead glass has a lower softening point the alumina glass. Thus, the baking temperature can be lowered than in the first embodiment Therefore, the upheaved height of the bulging glaze layer 2' is prevented from reducing when the electrode-carrying glaze layer 3' and the insulating protection layer 6' are baked. As a result a predetermined value of the upheaved height of the bulging glaze layer 2 is reliably maintained, thereby improving the fitting condition (and hence the printing quality) of the thermal head relative to the transfer ink ribbon or the thermosensitive printing paper.

Further, since the heating resistor layer 5' is covered by the insulating protection layer 6' made of amorphous glass and having a smooth surface, it is possible to bring the resistor layer into smooth contact with the transfer ink ribbon or the thermosensitive recording paper. Further, when the insulating protection layer 6' is made of the same lead glass material as used for the electrode-carrying glaze layer 3, the insulating protection layer 6' is advantageously attached to the electrode-carrying glaze layer 3'. Thus, it is possible to prevent the insulating protection layer 6' from easily coming off and to mechanically reinforce the electrode-carrying glaze layer 3'.

The preferred embodiments of the present invention being thus described, the present invention is not limited to these embodiments but may be varied in many ways. For instance, the electrode-carrying glaze layer 4 (4') or the bulging glaze layer 2 (2') may be formed by any kind of glass material as long as the material is amorphous.

We claim:

1. A thermal head comprising:

an insulating substrate;

a bulging glaze layer of amorphous glass formed on a surface of the insulating substrate;

a heating resistor layer formed on the bulging glaze layer;

an electrode-carrying glaze layer formed on said surface of the insulating substrate to partially overlap the bulging glaze layer; and an electrode layer formed on the electrode-carrying glaze layer and over portions of the bulging glaze layer, overlapping portions of the heating resistor layer;

wherein each of the bulging glaze layer and the electrode carrying glaze layer is made of amorphous glass, the electrode-carrying glaze layer having a smaller thickness than the bulging glaze layer.

2. The thermal head according to claim 1, wherein the electrode-carrying glaze layer and the bulging glaze layer are made of a same amorphous glass material.

3. The thermal head according to claim 2, wherein said same amorphous glass material is alumina glass.

4. The thermal head according to claim 1, wherein the electrode-carrying glaze layer and the bulging glaze layer are respectively made of a different amorphous glass material.

5. The thermal head according to claim 4, wherein the bulging glaze layer is made of amorphous alumina glass, and the electrode-carrying glaze layer is made of amorphous lead glass.

6. The thermal head according to claim 1, wherein the electrode layer and the heating resistor layer are covered by an insulating protection layer, the insulating protection layer being made of an amorphous glass.

7. The thermal head according to claim 2, wherein the insulating protection layer and the electrode-carrying glaze layer are made of a same amorphous glass material.

8. The thermal head according to claim 7, wherein said same amorphous glass material is alumina glass.

9. The thermal head according to claim 7, wherein said same amorphous glass material is lead glass.

10. The thermal head according to claim 1, wherein said surface of the insulating substrate is entirely covered by the electrode-carrying glaze layer except for a region provided with the bulging glaze layer.

11. The thermal head according to claim 1, further comprising at least one drive IC directly mounted on the electrode-carrying glaze layer for selective heating of the heating resistor layer.

12. The thermal head according to claim 1, further comprising a driver-carrying glaze layer formed on said surface of the insulating substrate at a position spaced from the bulging glaze layer for carrying at least one drive IC, the electrode-carrying glaze layer bridging between the bulging glaze layer and the driver-carrying glaze layer.

13. The thermal head according to claim 12, wherein the electrode-carrying glaze layer is made of an amorphous glass material having a lower softening point than the bulging glaze layer.

14. The thermal head according to claim 13, wherein the amorphous glass material of the electrode-carrying glaze layer is lead glass.

15. The thermal head according to claim 12, wherein the driver-carrying glaze layer and the bulging glaze layer are made of a same amorphous glass material.

16. A method of making a thermal head comprising the steps of:

forming a bulging glaze layer of an amorphous glass on a surface of an insulating material;

forming an electrode-carrying glaze layer on said surface of the insulating substrate so that the electrode-carrying glaze layer partially overlaps the bulging glaze layer; and forming a heating resistor layer and an electrode layer in an overlapping manner on the bulging glaze layer;

wherein the forming step of the electrode-carrying glaze layer includes a first procedure of printing an amorphous glass paste in a manner causing the amorphous glass paste to partially overlap the bulging glaze layer and have a thickness smaller than a height of the bulging glass layer, and a second procedure of baking the printed amorphous glass paste at a temperature lower than a temperature for baking the bulging glaze layer.

17. The method according to claim 16, further comprising the step of mounting at least one drive IC on the electrode-carrying glaze layer, the drive IC electrically connected to the electrode layer.

18. The method according to claim 16, wherein a driver-carrying glaze layer is formed together with but spaced from the bulging glaze layer, the driver-carrying glaze layer supporting at least one drive IC electrically connected to the electrode layer.

19. A thermal head comprising:

an insulating substrate;

a bulging glaze layer of amorphous glass formed on a surface of the insulating substrate;

an electrode-carrying glaze layer formed on said surface of the insulating substrate to partially overlap the bulging glaze layer;

an electrode layer formed on the electrode-carrying glaze layer and over portions of the bulging glaze layer; and a heating resistor layer formed on the bulging glaze layer and overlapping those portions of the electrode layer formed over the bulging glaze layer;

wherein each of the bulging glaze layer and the electrode carrying glaze layer is made of amorphous glass, the electrode-carrying glaze layer having a smaller thickness than the bulging glaze layer.

* * * * *